US011135841B2

(12) United States Patent
Nagai et al.

(10) Patent No.: US 11,135,841 B2
(45) Date of Patent: Oct. 5, 2021

(54) LIQUID DISCHARGE HEAD AND MANUFACTURING METHOD OF THE SAME

(71) Applicant: CANON KABUSHIKI KAISHA, Tokyo (JP)

(72) Inventors: Masataka Nagai, Yokohama (JP); Masafumi Morisue, Tokyo (JP); Koji Sasaki, Nagareyama (JP); Seiichiro Yaginuma, Kawasaki (JP); Shinji Kishikawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 10 days.

(21) Appl. No.: 16/837,797

(22) Filed: Apr. 1, 2020

(65) Prior Publication Data

US 2020/0331266 A1 Oct. 22, 2020

(30) Foreign Application Priority Data

Apr. 16, 2019 (JP) ..... JP2019-078176

(51) Int. Cl.
*B41J 2/14* (2006.01)

(52) U.S. Cl.
CPC .. *B41J 2/14201* (2013.01); *B41J 2002/14419* (2013.01)

(58) Field of Classification Search
CPC ..... B41J 2/14201; B41J 2002/14419; B41J 2202/12; B41J 2/1603; B41J 2/1631; B41J 2/1645; B41J 2/1626; B41J 2/1404
See application file for complete search history.

(56) References Cited

U.S. PATENT DOCUMENTS 9,156,262 B2 10/2015 Taff
2017/0087838 A1* 3/2017 Yabe ..... B41J 2/1637

OTHER PUBLICATIONS

IP.com search (Year: 2021).*

* cited by examiner

*Primary Examiner* — Lisa Solomon

(74) *Attorney, Agent, or Firm* — Canon U.S.A., Inc. I.P. Division

(57) ABSTRACT

A liquid discharge head includes a discharge port member including a discharge port, a flow path member including a pressure chamber and a liquid flow path, a substrate, and a structure that is arranged on the substrate on an upstream side of a center of the discharge port and that is configured to generate a flow of the liquid toward the discharge port. The liquid in the pressure chamber circulates. A position corresponding to a portion of the structure having a greatest height from a surface of the substrate is located on the upstream side of the center of the discharge port in a flow direction of the liquid. A thickness of the structure in a discharge direction of the liquid is 0.1 times or greater than a thickness of the liquid flow path in the discharge direction of the liquid.

20 Claims, 21 Drawing Sheets

LIQUID DISCHARGE HEAD AND MANUFACTURING METHOD OF THE SAME

BACKGROUND OF THE DISCLOSURE

Field of the Disclosure

The present disclosure relates to a liquid discharge head and a manufacturing method of the liquid discharge head.

Description of the Related Art

When a state in which liquid is not discharged from a discharge port of a liquid discharge head continues, the liquid may gradually evaporate from the discharge port and a viscosity of the liquid may increase near the discharge port. The increase in viscosity of the liquid might lead to lower recording quality and a liquid discharge malfunction.

U.S. Pat. No. 9,156,262 discusses a method of preventing thickening of liquid near the discharge port. Specifically, U.S. Pat. No. 9,156,262 discusses a configuration in which a discharge port member forming the discharge port has a two-tier configuration. With this configuration, when liquid circulates between the inside and outside of a pressure chamber, liquid that has not been thickened is caused to flow to the vicinity of the discharge port.

In the method discussed in U.S. Pat. No. 9,156,262, a sufficient amount of liquid does not flow to the inside of a discharge port depending on conditions such as flow velocity of the liquid even if a discharge port member forming the discharge port has a two-tier configuration, and thus thickened liquid inside the discharge port might not be sufficiently replaced with liquid that has not been thickened.

SUMMARY OF THE DISCLOSURE

Various aspects of present disclosure are directed to numerous embodiments and features thereof for preventing increase in viscosity of liquid inside the discharge port by causing liquid to flow to the inside of the discharge port.

According to an aspect of the present disclosure, a liquid discharge head includes a discharge port member including a discharge port from which liquid is discharged, a flow path member including a pressure chamber internally having an energy generating element configured to generate energy to discharge the liquid from the discharge port, and a liquid flow path in which the liquid flows toward the pressure chamber, a substrate including a liquid supply port from which the liquid is supplied to the liquid flow path, and a structure that is arranged on the substrate on an upstream side of a center of the discharge port in the pressure chamber or the liquid flow path and that is configured to generate a flow of the liquid toward the discharge port. The liquid in the pressure chamber circulates between inside and outside the pressure chamber. A position corresponding to a portion of the structure having a greatest height from a surface of the substrate is located on the upstream side of the center of the discharge port in a flow direction of the liquid. A thickness of the structure in a discharge direction of the liquid is 0.1 times or greater than a thickness of the liquid flow path in the discharge direction of the liquid.

Further features and aspects of the present disclosure will become apparent from the following description of numerous example embodiments with reference to the attached drawings.

DESCRIPTION OF THE EMBODIMENTS

Hereinafter, the present disclosure is directed to numerous embodiments, features and aspects thereof for preventing increase in viscosity of liquid inside the discharge port by causing liquid to flow to the inside of the discharge port.

First Example Embodiment (Example Liquid Discharge Head)

Figure 1:
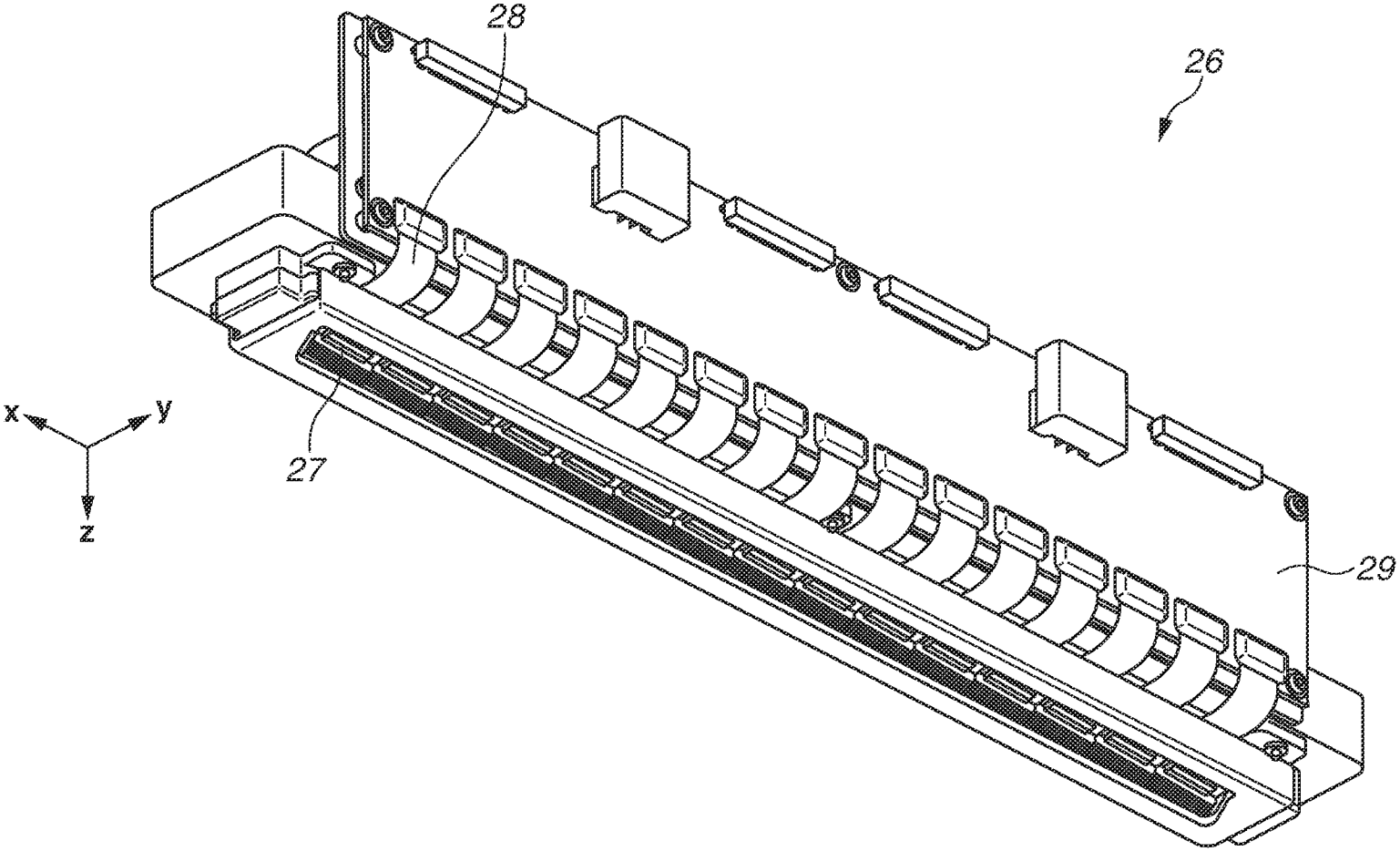
FIG. 1 is a perspective view illustrating an example liquid discharge head.

A liquid discharge head 26 will be described with reference to FIG. 1 which is a perspective view illustrating the liquid discharge head 26 according to a first example embodiment. The liquid discharge head 26 mainly includes a recording element substrate 27, a flexible wiring substrate 28, and an electric wiring substrate 29. The recording element substrate 27 discharges liquid. The flexible wiring substrate 28 supplies power to the recording element substrate 27. The electric wiring substrate 29 is electrically connected to the flexible wiring substrate 28 and is connected to a recording apparatus main body. The liquid discharge head 26 illustrated in FIG. 1 is a page-wide type liquid discharge head that corresponds to a width of a recording medium such as paper by arranging a plurality of recording element substrates 27 in an x-direction. The liquid discharge head 26 according to the present disclosure has a configuration in which liquid circulates between the inside and outside of a pressure chamber 20, which will be described below in detail.

Example Recording Element Substrate

Figure 2A:
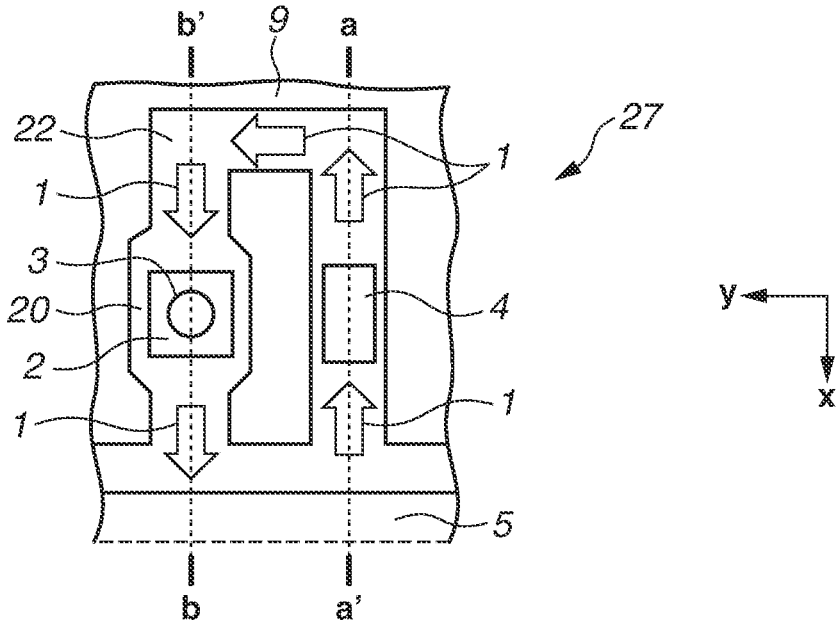
FIGS. 2A to 2C are schematic views each illustrating an example recording element substrate.
Figure 2B:
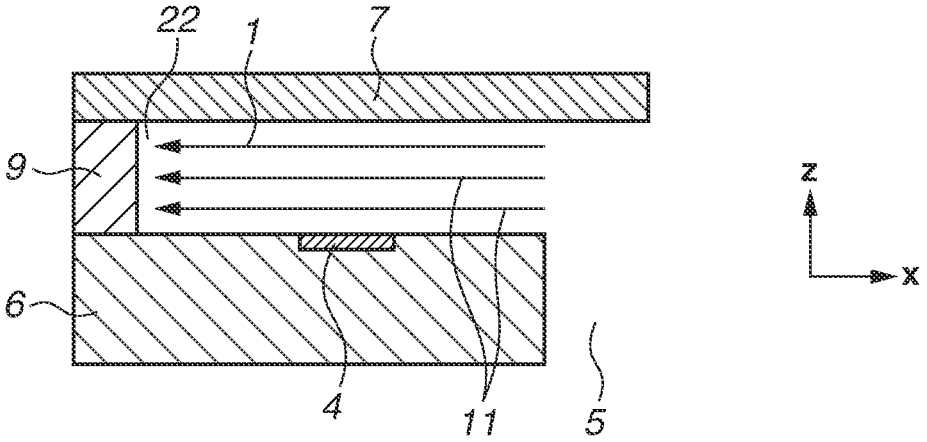
Figure 2C:
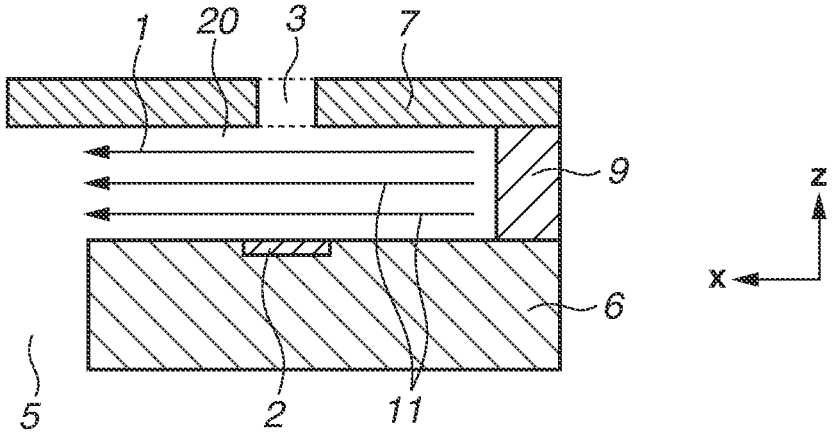

A configuration of the recording element substrate 27 will be described with reference to FIG. 2A to 2C. FIG. 2A is a schematic view illustrating part of the recording element substrate 27 of the liquid discharge head 26 according to the present example embodiment. FIG. 2B is a schematic view illustrating a cross section along a line a-a' illustrated in FIG. 2A. FIG. 2C is a schematic view illustrating a cross section along a line b-b' illustrated in FIG. 2A.

The recording element substrate 27 mainly includes a discharge port 3, an energy generating element 2, and the pressure chamber 20 including the discharge port 3 and the energy generating element 2, as illustrated in FIG. 2A. The discharge port 3 discharges liquid. The energy generating element 2 generates energy for discharging liquid. The recording element substrate 27 further includes a circulation energy generating element 4. The recording element substrate 27 drives the circulation energy generating element 4 to cause liquid to flow from a liquid supply port 5 formed in a substrate 6 to a liquid flow path 22 and to the pressure chamber 20 in this order (indicated by arrow 1) to circulate liquid between the inside and outside of the pressure chamber 20. Examples of the circulation energy generating element 4 include a heating element and a piezoelectric element. The pressure chamber 20 and the liquid flow path 22 are formed by a flow path member 9.

Circulating liquid causes the liquid to flow in a direction of the arrow 1, i.e., in the x-direction and a y-direction of the liquid flow path 22 (direction orthogonal to the direction in which the liquid flows and a direction in which the liquid is discharged). However, little amount of liquid flows in a z-direction (direction in which the liquid is discharged) illustrated in FIG. 3C, i.e., toward the discharge port 3. This configuration will be described below.

Example Structure

Figure 3A:
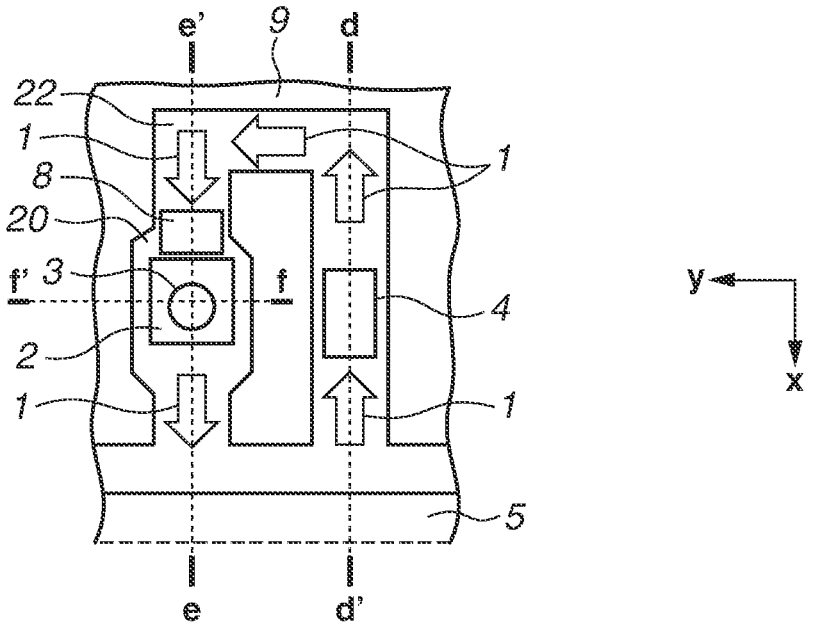
FIGS. 3A to 3C are schematic views each illustrating an example structure for the recording element substrate.
Figure 3B:
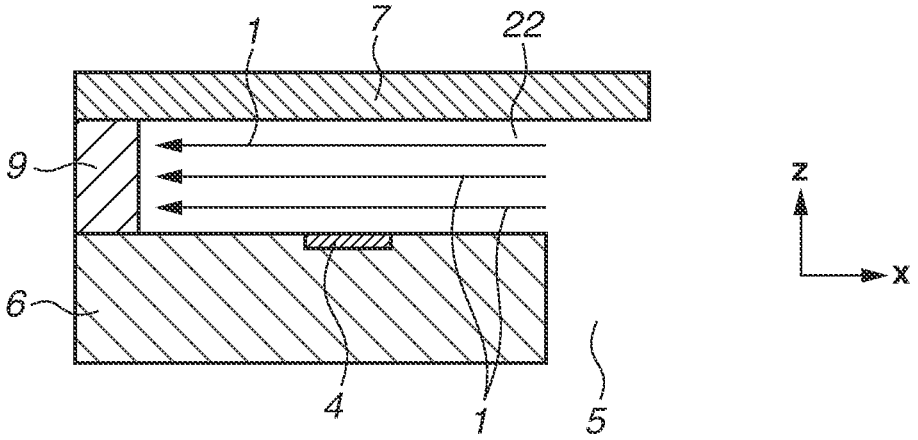
Figure 3C:
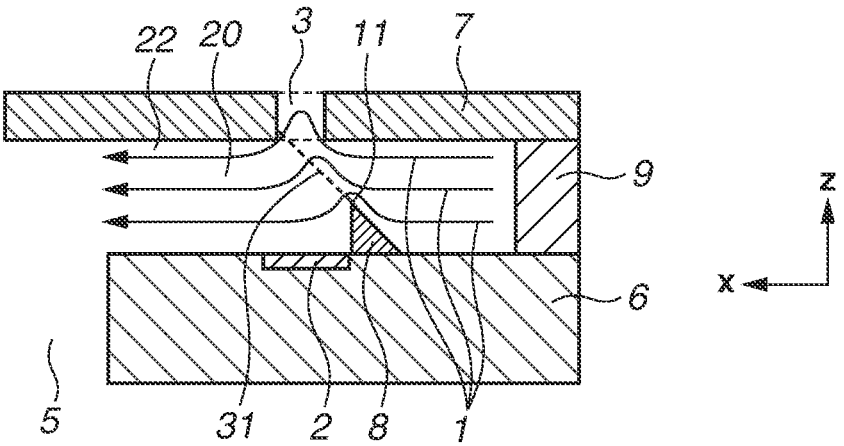

A structure 8, which characterizes the present disclosure, will be described with reference to FIGS. 3A to 3C, FIGS. 4A and 4B, FIG. 5, and FIG. 6. FIG. 3A illustrates a case where the structure 8 is arranged in the recording element substrate 27 illustrated in FIGS. 2A to 2C. FIG. 3B is a schematic view illustrating a cross section along a line d-d' illustrated in FIG. 3A. FIG. 3C is a schematic view illustrating a cross section along a line e-e' illustrated in FIG. 3A. As illustrated in FIG. 3C, the structure 8 has the shape of a triangular prism, and is mounted on the substrate 6 such that a side surface of the triangular prism faces the substrate 6. The structure 8 is arranged inside the pressure chamber 20 or in the liquid flow path 22. Specifically, a position 11 corresponding to a portion of the structure 8 having the greatest height from a surface of the substrate 6 in the z-direction is located on the upstream side of the center of the discharge port 3 in the x-direction, i.e., the in the flow direction of liquid. FIG. 3C illustrates the structure 8 having the shape of a right triangular prism. The structure 8, which will be described below in detail, is desirably made of a resin for easier manufacturing.

In the liquid flow path 22 on the upstream side of the structure 8 in the flow direction of liquid, the flow of liquid, as illustrated in FIG. 3B, is similar to that in the recording element substrate 27 illustrated in FIGS. 2A to 2C. However, the flow of liquid toward the inside of the discharge port 3 is generated on the downstream side of the structure 8, as illustrated in FIG. 3C. That is, the structure 8 generates the flow toward the discharge port 3. This is because the structure 8 prevents liquid from flowing linearly in the x-direction, which causes the liquid to have a flow component in the z-direction such that the liquid flows over the structure 8. This configuration allows the liquid to flow to the inside of the discharge port 3, thereby enabling replacement of liquid having an increased viscosity inside the discharge port 3 with liquid having a viscosity which has not yet been increased. Therefore, the increase in viscosity of liquid inside the discharge port 3 can be prevented.

Figure 4A:
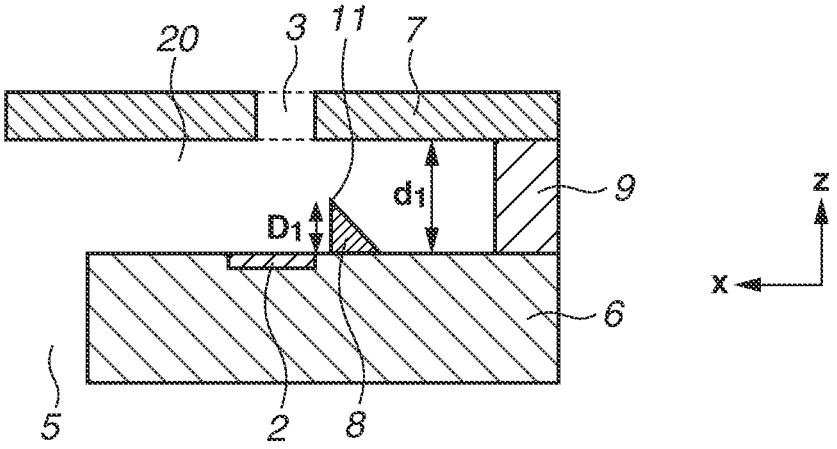
FIGS. 4A and 4B are schematic views each illustrating an example height and width of the structure.
Figure 4B:
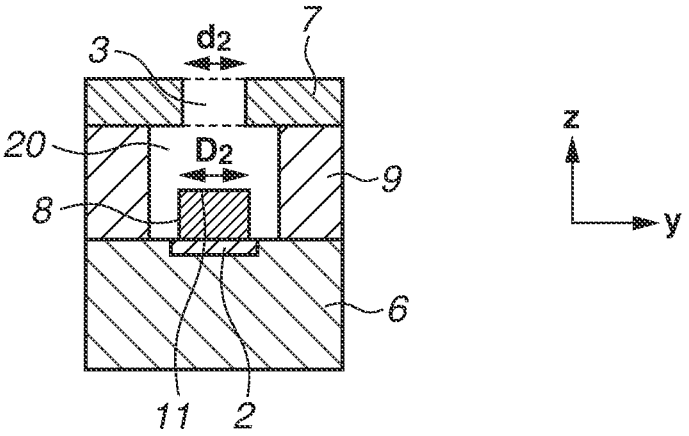
Figure 5:
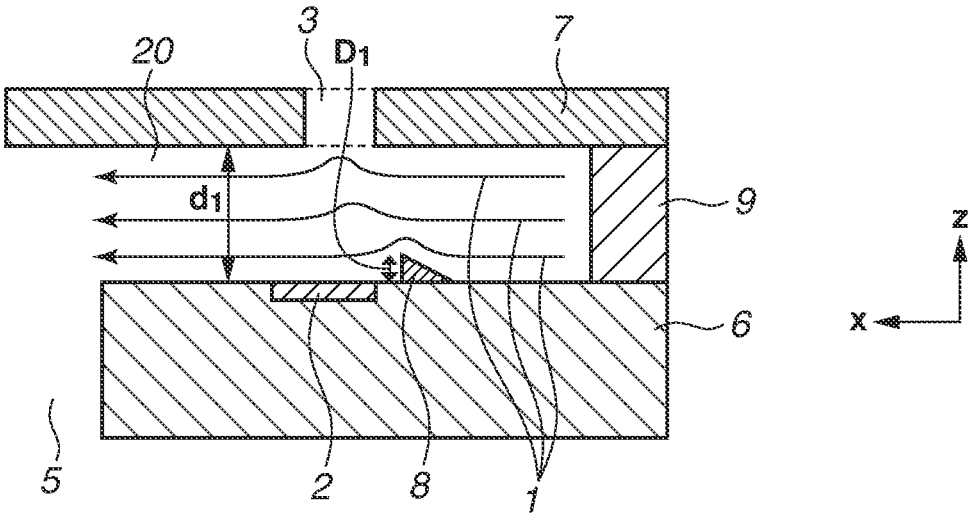
FIG. 5 is a schematic view illustrating a height of a structure according to a comparative example.

A height and width of the structure 8 will be described next with reference to FIGS. 4A and 4B, and FIG. 5. FIG. 4A is a schematic view illustrating a cross section along a line e-e' illustrated in FIG. 3A. FIG. 4B is a view illustrating the structure 8 added to a schematic view of a cross section along a line f-f illustrated in FIG. 3A. FIG. 5 illustrates a comparative example with respect to FIG. 4A. A height of the structure 8, i.e., a thickness in the z-direction thereof (length from the surface of the substrate 6 to the highest position in the z-direction) is referred to as a height $D_1$, and a height in the z-direction of the pressure chamber 20 is referred to as a height $d_1$. In this case, in order to cause liquid to flow to the inside of the discharge port 3, the height $D_1$ is desirably 0.1 times or greater than the height $d_1$ ($D_1 \geq 0.1d_1$). This is because a distance between the discharge port 3 and the structure 8 relates to the configuration of causing liquid to flow to the inside of the discharge port 3. That is, when the relation of $D_1 \geq 0.1d_1$ holds, a distance between the discharge port 3 and the position 11 corresponding to the portion of the structure 8 having the greatest height from the surface of the substrate 6 is relatively short, so that the liquid flowing over the structure 8 reaches the inside of the discharge port 3. The height $d_1$ in the z-direction of the pressure chamber 20 corresponds to a length in the z-direction from the surface of the substrate 6 to a surface of a discharge port member 7 facing the liquid flow path 22. The height $D_1$ of the structure 8 is desirably 0.8 times or less than the height $d_1$ ($0.1d_1 \leq D_1 \leq 0.8d_1$). This is because when the relation of $D_1 > 0.8d_1$ holds, the structure 8 occupies a higher proportion of the pressure chamber 20, and thus the structure 8 largely blocks the pressure chamber 20, resulting in reduction of the refill speed of liquid.

On the other hand, when the relation of $D_1 \geq 0.1d_1$ does not hold, i.e., the relation of $D_1 < 0.1d_1$ holds, the flow of liquid on the downstream side of the structure 8 slightly changes in the z-direction, which produces little effect of flowing liquid to the inside of the discharge port 3. This is because the discharge port 3 and the position 11 corresponding to the highest portion of the structure 8 from the substrate 6 are away from each other. Thus, when the relation of $D_1 < 0.1d_1$ holds, liquid having an increased viscosity inside the discharge port 3 is less likely to be replaced with liquid having a viscosity that has not been increased, which produces little effect of preventing the increase in the viscosity of liquid inside the discharge port 3. FIG. 5 illustrates the structure 8 having a height of 0.1 times or greater than the height $d_1$.

In this case, in order to cause liquid to flow further to the inside of the discharge port 3, the height $D_1$ is desirably 0.3 times or greater than the height $d_1$ ($D_1 \geq 0.3\ d_1$). Furthermore, if the height of the structure 8 with respect to the height of the pressure chamber 20 is increased to be 0.3 times or greater than the height $d_1$ ($D_1 \geq 0.3\ d_1$) or even 0.7 times or greater than the height $d_1$ ($D_1 \geq 0.7\ d_1$), it allows a larger amount of liquid to flow to the inside of the discharge port 3.

If a length of the structure 8 in the y-direction, i.e., a width (thickness in y-direction) of the structure 8, is referred to as a length $D_2$ and a length (width) of the discharge port 3 in the y-direction is referred to as a length $d_2$ as illustrated in FIG. 4B, it is desirable that the relation of $D_2 \geq d_2$ be satisfied. This is because, in the relation, the length in the y-direction of the flow of liquid flowing over the structure 8 in the z-direction becomes substantially equal to the length $D_2$, which is the width of the structure 8. That is, in order to cause liquid to flow to the inside of the discharge port 3 over the entire region of the width of the discharge port 3, the relation of $D_2 \geq d_2$ is desirably satisfied. In a case where the relation of $D_2 \geq d_2$ is not satisfied, i.e., the relation of $D_2 < d_2$ holds, the amount of liquid corresponding to the length $D_2$ with respect to the entire region of the length (width) $d_2$ of the discharge port 3 flows to the inside of the discharge port 3. Therefore, as described above, the relation of $D_2 \geq d_2$ is desirably satisfied to prevent the increase in viscosity of liquid inside the discharge port 3.

Figure 6:
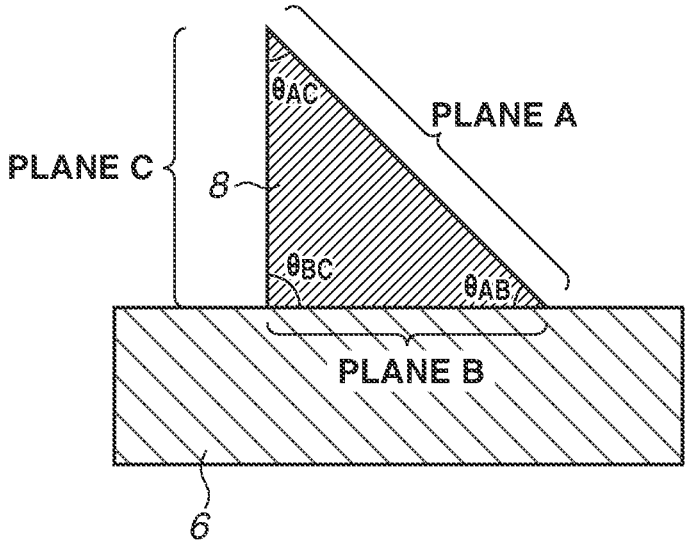
FIG. 6 is a schematic view illustrating the example structure.

An angle of the structure 8 will be described with reference to FIG. 6. FIG. 6 is a schematic view illustrating the structure 8. In the following description, a plane of the structure 8 facing the upstream side in the flow of liquid is referred to as a plane A, a plane in contact with the substrate 6 is referred to as a plane B, and a plane facing the downstream side of the flow of liquid is referred to as a plane C. An angle between the plane A and the plane B is referred to as an angle θAB, an angle between the plane B and the plane C is referred to as an angle θBC, and an angle between the plane A and the plane C is referred to as an angle θAC. In this case, the relation of $20° \leq \theta AB \leq 90°$ is desirably satisfied to achieve the effect of the present disclosure. This is because, when the relation of $\theta AB < 20°$ holds, the flow of liquid that has flown past the structure 8 is substantially the same as the flow of liquid in the case where the structure 8 is not arranged, and thus the structure 8 produces little effect of replacing liquid inside the discharge port 3. This is also because, when a relation of $\theta AB > 90°$ (θAB is obtuse angle) holds, little amount of liquid flows to the downstream side along a slope of the plane A, and thus little amount of liquid flowing over the structure 8 in the z-direction can be obtained. However, the configuration is not limited thereto, and the angle AB may be an obtuse angle. Even if the angle θAB is the obtuse angle, not a little amount of liquid can be caused to flow in the z-direction.

When liquid is flowing over the structure 8 in the z-direction, an inclination of the flow of the liquid from the substrate 6 is substantially equal to the angle θAB of the structure 8. Thus, when the angle θAB is small, the structure 8 is desirably arranged at a position a little away from the discharge port 3 to cause liquid to flow to the discharge port 3. In other words, to cause liquid to flow to the discharge port 3 in a case where it is difficult to arrange the structure 8 near the discharge port 3, the angle AB is desirably made small, for example, to be 30°.

In order to cause liquid to flow to the inside of the discharge port 3, the structure 8 is desirably arranged such that the discharge port 3 is located on an extension line 31 (FIG. 3C) of the plane A of the structure 8. This is because, in a case where the discharge port 3 is not located on the extension line 31 of the plane A, liquid flowing over the structure 8 merely hits against the discharge port member 7 on the upstream side or the downstream side of the discharge port 3, and is less likely to flow to the inside of the discharge port 3.

Second Example Embodiment

Figure 8A:
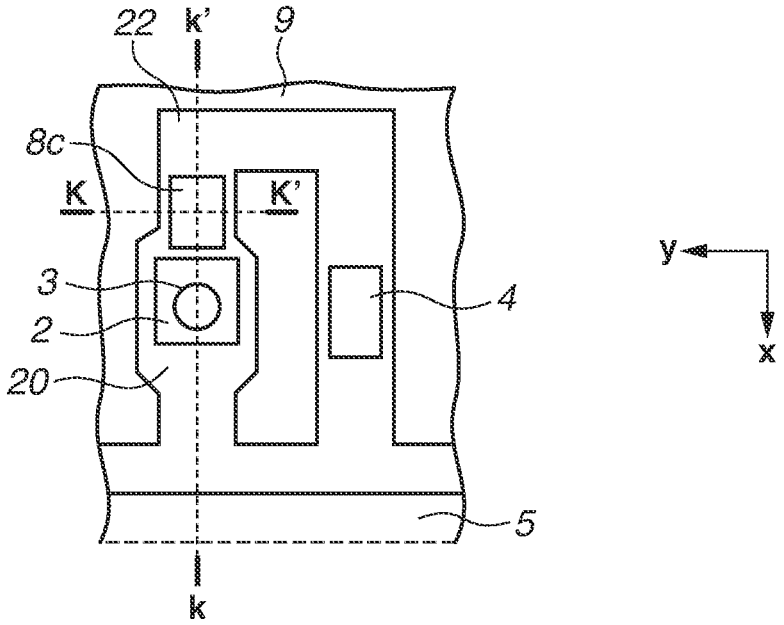
FIGS. 8A to 8C are schematic views each illustrating a recording element substrate according to a second example embodiment.
Figure 8B:
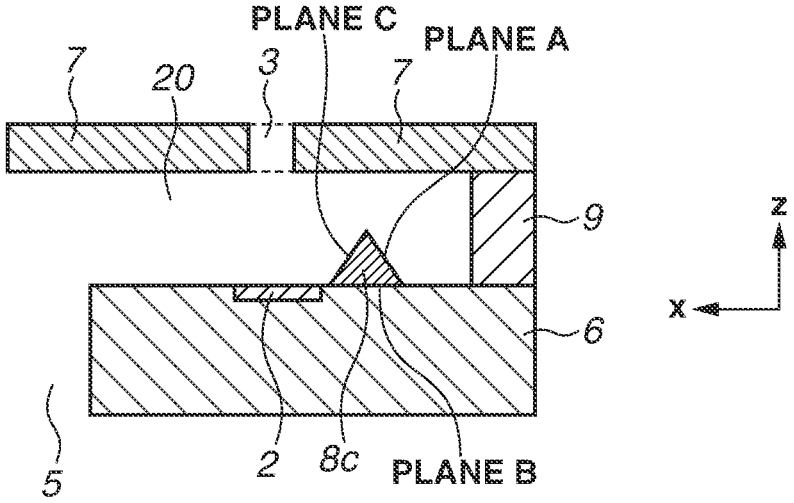
Figure 8C:
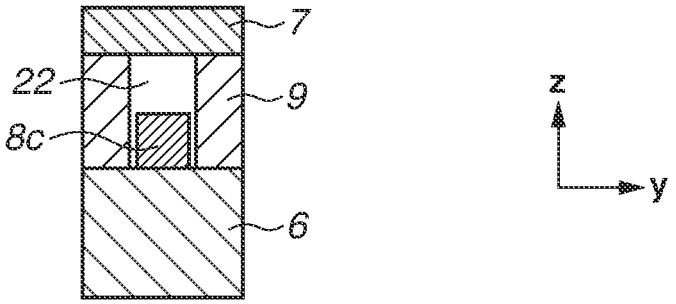

A second example embodiment will be described with reference to FIGS. 8A to 8C. The components similar to those of the first example embodiment are denoted by the same reference numerals or signs, and the description thereof is thus omitted. FIG. 8A is a schematic view illustrating a recording element substrate having a structure 8*c* according to the second example embodiment. FIG. 8B is a schematic view illustrating a cross section along a line k-k' illustrated in FIG. 8A. FIG. 8C is a schematic view illustrating a cross section along a line K-K' illustrated in FIG. 8A.

The present example embodiment is characterized in that the angle (BC) between the plane B and the plane C is an acute angle. Setting the angle θBC to be an acute angle allows liquid to flow smoothly on the plane C. This configuration can prevent the flow of liquid from stagnating near the angle (BC) between the plane B and the plane C. FIGS. 8A to 8C each illustrate the structure 8*c* having a height of 10 μm as an example.

Third Example Embodiment

Figure 9A:
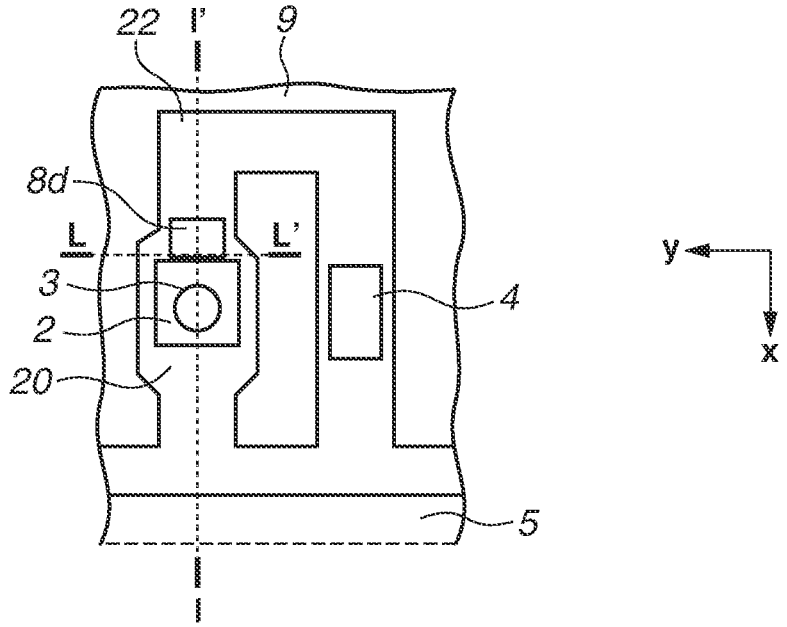
FIGS. 9A to 9C are schematic views each illustrating a recording element substrate according to a third example embodiment.
Figure 9B:
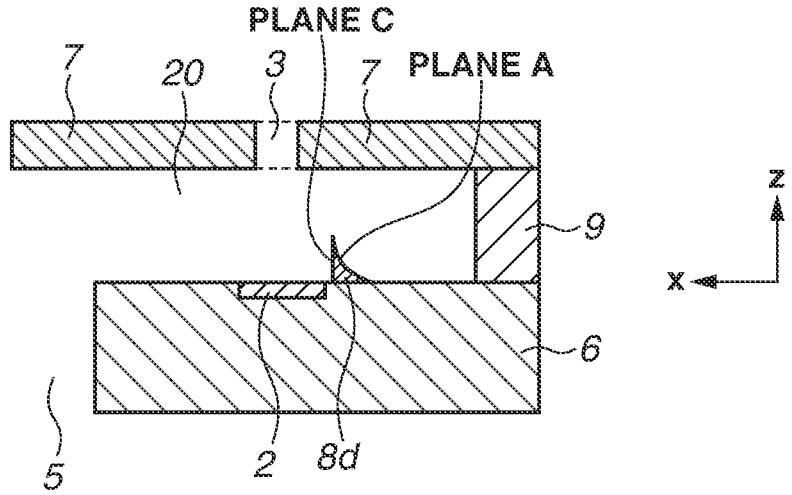
Figure 9C:
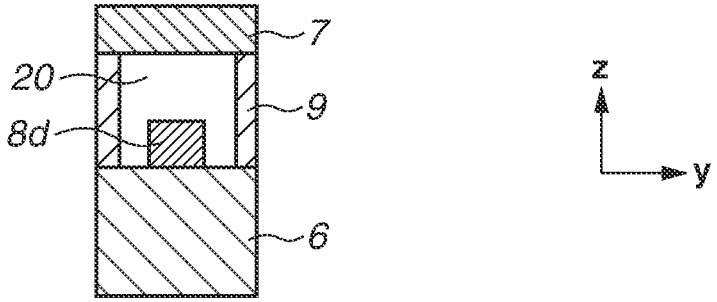

A third example embodiment will be described with reference to FIGS. 9A to 9C. The components similar to those of the first example embodiment are denoted by the same reference numerals or signs, and the description thereof is thus omitted. FIG. 9A is a schematic view illustrating a recording element substrate having a structure 8*d* according to the third example embodiment. FIG. 9B is a schematic view illustrating a cross section along a line l-l' illustrated in FIG. 9A. FIG. 9C is a schematic view illustrating a cross section along a line L-L' illustrated in FIG. 9A.

The present example embodiment is characterized in that the plane A is not formed as a straight line but curved toward the discharge port 3. FIGS. 9A to 9C each illustrate the structure 8*d* having a height of 10 μm as an example. The plane A is curved and rises sharply so that even if a length of the plane B is shortened, the structure 8*d* having a sufficient height can be obtained. In FIGS. 9A to 9C, the length of the plane B is 5 μm. Further, the angle θAC between the plane A and the plane C is about 15°. In the present example embodiment, the angle θAC is an average value of angles which are formed between the plane C and respective tangent lines at ten points randomly selected from the plane A. Forming the plane A as a curved surface allows the structure 8*d* having a desired height to be formed in a smaller region, thereby achieving a sufficient amount of liquid flowing in the z-direction even if not so much space can be secured in the region where the structure 8*d* is arranged.

Fourth Example Embodiment

Figure 10A:
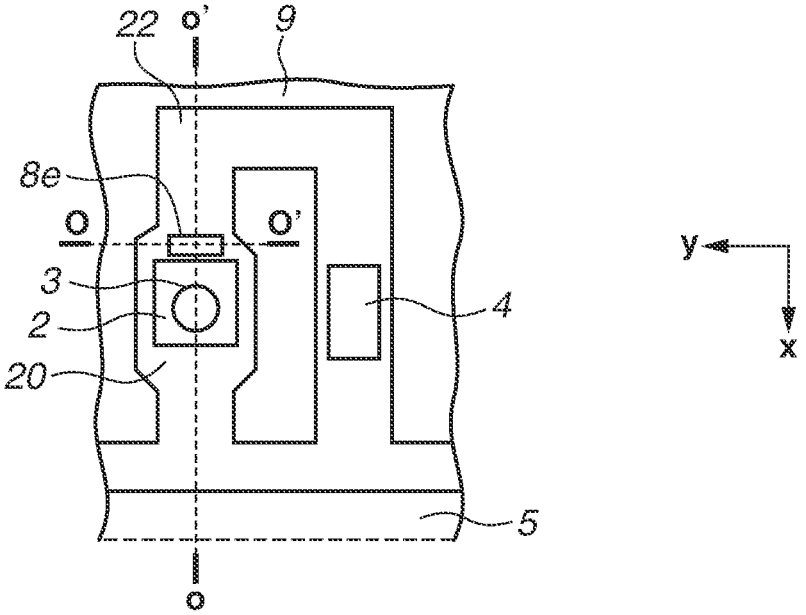
FIGS. 10A to 10C are schematic views each illustrating a recording element substrate according to a fourth example embodiment.
Figure 10B:
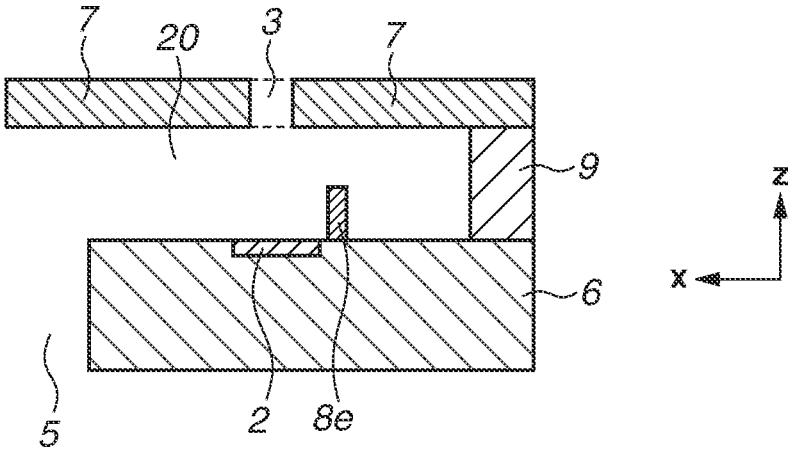
Figure 10C:
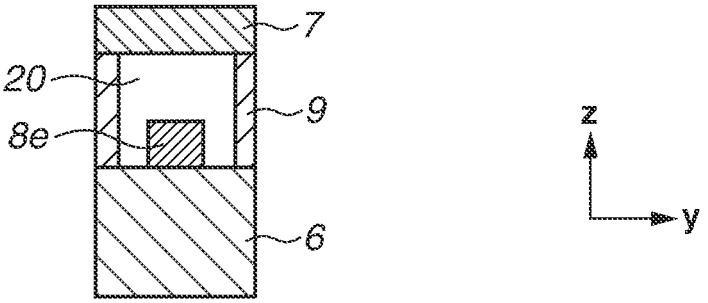

A fourth example embodiment will be described with reference to FIGS. 10A to 10C. The components similar to those of the first example embodiment are denoted by the same reference numerals or signs, and the description thereof is thus omitted. FIG. 10A is a schematic view illustrating a recording element substrate having a structure 8*e* according to the fourth example embodiment. FIG. 10B is a schematic view illustrating a cross section along a line o-o' illustrated in FIG. 10A. FIG. 10C is a schematic view illustrating a cross section along a line O-O' illustrated in FIG. 10A.

The present example embodiment is characterized in that the structure 8*e* having the shape of a cuboid is used. FIGS. 10A to 10C each illustrate the structure 8*e* having a height of 10 μm as an example. The structure 8*e* formed in the shape of a cuboid can significantly reduce an installation area of the structure 8*e* with respect to the substrate 6, which is advantageous in that an installation location of the structure 8*e* inside the pressure chamber 20 or the liquid flow path 22 is less likely to be limited.

Fifth Example Embodiment

Figure 11A:
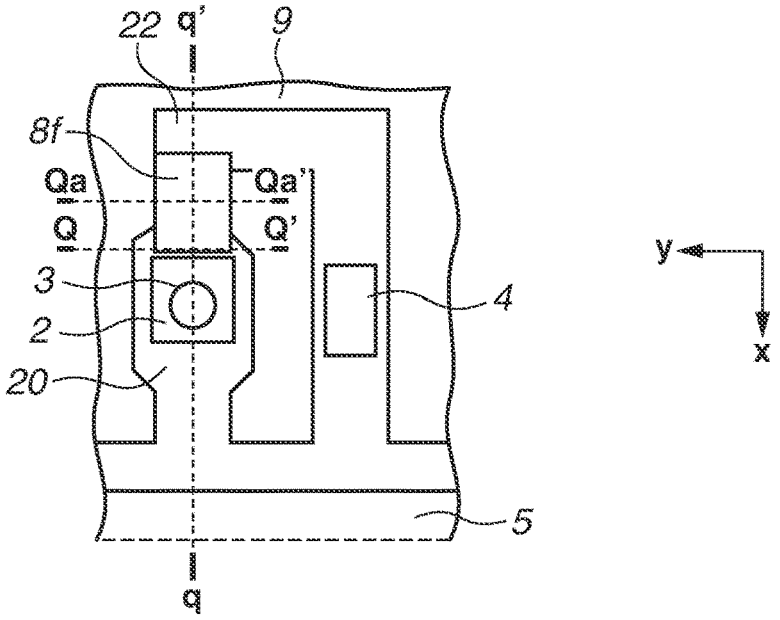
FIGS. 11A to 11D are schematic views each illustrating a recording element substrate according to a fifth example embodiment.
Figure 11B:
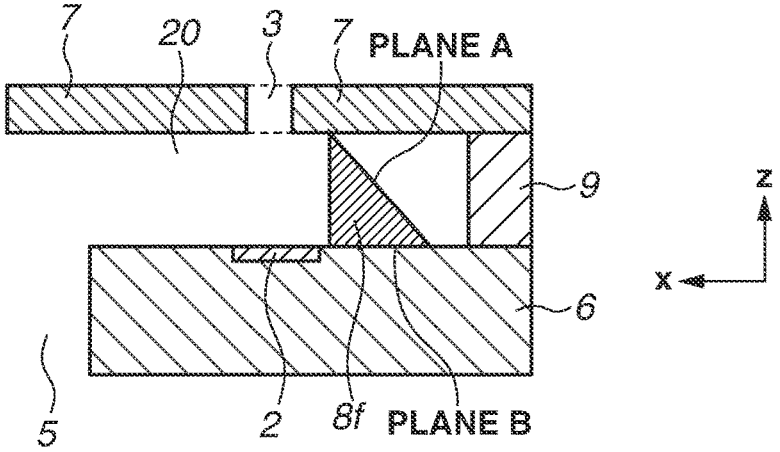
Figure 11C:
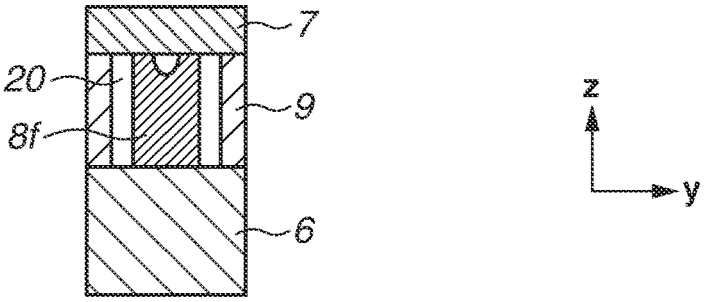
Figure 11D:
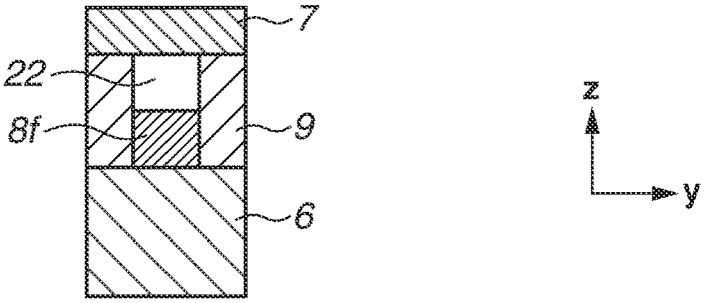

A fifth example embodiment will be described with reference to FIGS. 11A to 11D. The components similar to those of the first example embodiment are denoted by the same reference numerals or signs, and the description thereof is thus omitted. FIG. 11A is a schematic view illustrating a recording element substrate having a structure 8*f* according to the fifth example embodiment. FIG. 11B is a schematic view illustrating a cross section along a line q-q' illustrated in FIG. 11A. FIG. 11C is a schematic view illustrating a cross section along a line Q-Q' illustrated in FIG. 11A. FIG. 11D is a schematic view illustrating a cross section along a line Qa-Qa' illustrated in FIG. 11A.

The present example embodiment is characterized in that part of an upper portion of the structure 8*f* is in contact with the discharge port member 7. Further, the structure 8*f* near the discharge port 3 has such a shape as is obtained by hollowing out part of the structure 8*f* equivalent to the width of the discharge port 3. With this configuration, when liquid flows, a larger amount of liquid flows to the inside of the discharge port 3, so that the increase in viscosity of liquid inside the discharge port 3 can be further prevented. FIGS. 11A to 11D illustrate the structure 8*f* having a height of 20 μm and the plane B having a length of 20 μm as an example. While FIG. 11C illustrates the structure 8*f* having such a shape as is obtained by hollowing out part of the structure 8*f* equivalent to the width of the discharge port 3, the present example embodiment is not limited thereto. The structure 8*f* may have a shape that is obtained by hollowing out a larger portion than the width of the discharge port 3.

Sixth Example Embodiment

Figure 12A:
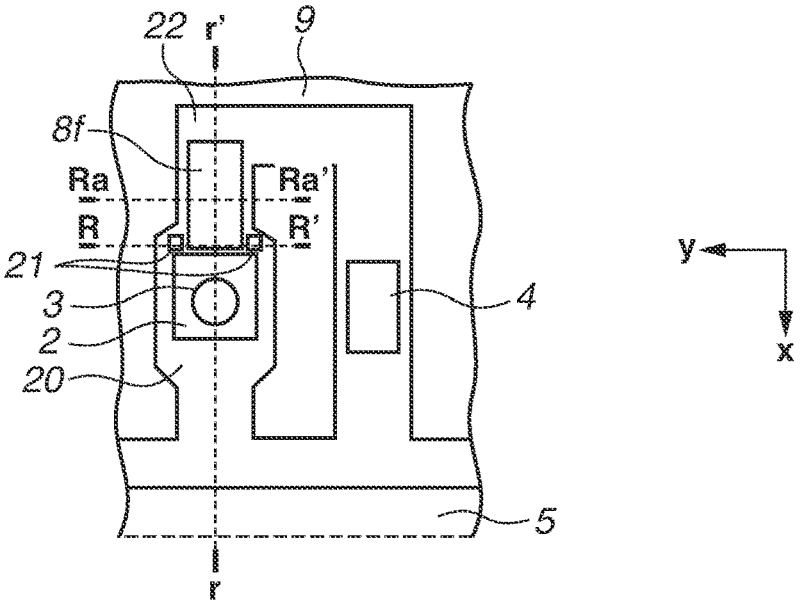
FIGS. 12A to 12D are schematic views each illustrating a recording element substrate according to a sixth example embodiment.
Figure 12B:
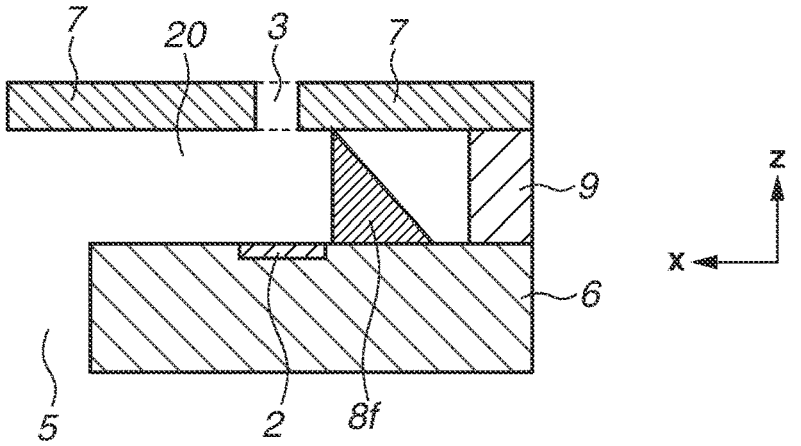
Figure 12C:
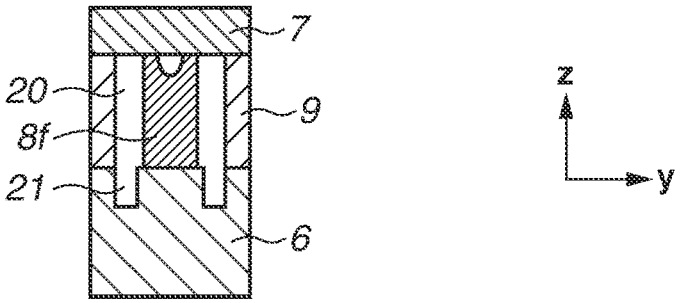
Figure 12D:
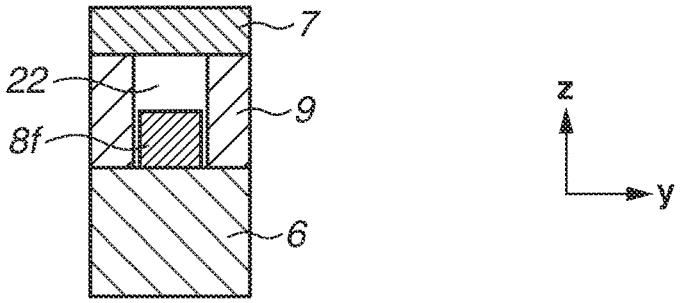

A sixth example embodiment will be described with reference to FIGS. 12A to 12D. The components similar to those of the first example embodiment are denoted by the same reference numerals or signs, and the description thereof is thus omitted. FIG. 12A is a schematic view illustrating a recording element substrate according to the sixth example embodiment. FIG. 12B is a schematic view illustrating a cross section along a line r-r' illustrated in FIG. 12A. FIG. 12C is a schematic view illustrating a cross section along a line R-R' illustrated in FIG. 12A. FIG. 12D is a schematic view illustrating a cross section along a line Ra-Ra' illustrated in FIG. 12A.

The present example embodiment is characterized in that the substrate 6 is provided with a groove 21. This configuration can improve refilling of liquid after discharge. FIGS. 12 A to 12D illustrate the same structure as that illustrated in the fifth example embodiment.

Seventh Example Embodiment

Figure 13A:
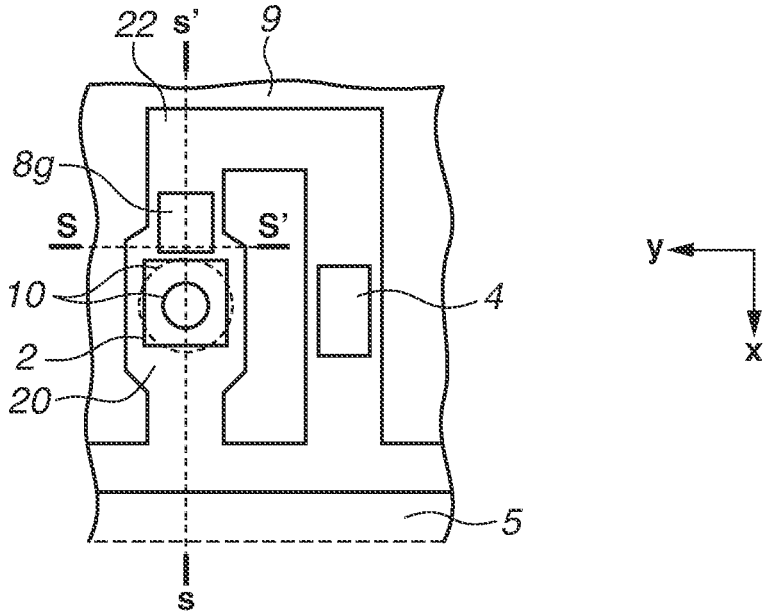
FIGS. 13A to 13C are schematic views each illustrating a recording element substrate according to a seventh example embodiment.
Figure 13B:
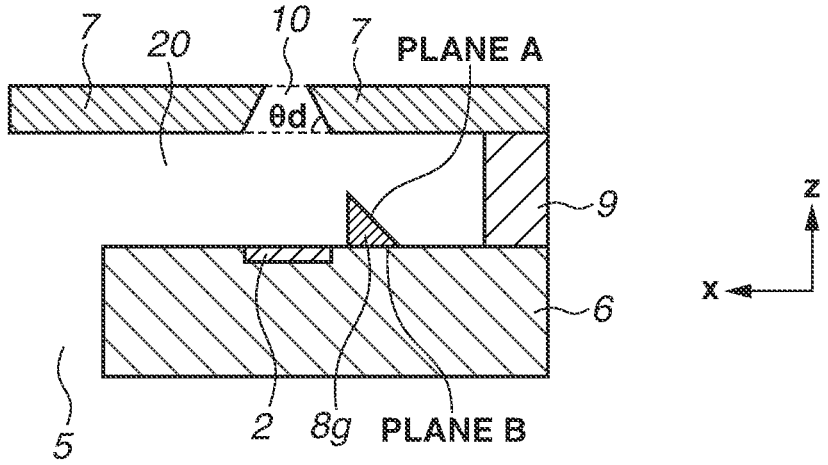
Figure 13C:
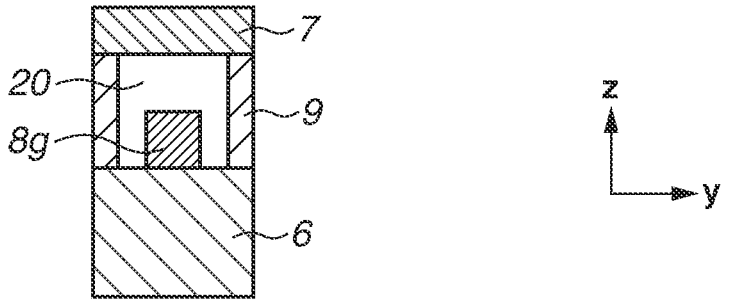

A seventh example embodiment will be described with reference to FIGS. 13A to 13C. The components similar to those of the first example embodiment are denoted by the same reference numerals or signs, and the description thereof is thus omitted. FIG. 13A is a schematic view illustrating a recording element substrate having a structure 8*g* according to the seventh example embodiment. FIG. 13B is a schematic view illustrating a cross section along a line s-s' illustrated in FIG. 13A. FIG. 13C is a schematic view illustrating a cross section along a line S-S' illustrated in FIG. 13A.

The present example embodiment is characterized in that an angle Hd of a discharge port 10 having a diameter that decreases toward the discharge direction of liquid is substantially equal to the angle θAB between the plane A and the plane B of the structure 8*g*. With this configuration, liquid can flow to the inside of the discharge port 10 effectively, so that the increase in viscosity of liquid can be further prevented. FIG. 13B illustrates the discharge port 10 and the structure 8*g* that satisfy the relation of $\theta AB=\theta d=45°$ as an example. The present example embodiment is not limited to the case where the angle θAB is equal to the angle θd. The present example embodiment desirably satisfies the relation of $\theta AB=\theta d\pm 15°\leq 90°$, and more desirably satisfies the relation of $\theta AB=\theta d\pm 5°\leq 90°$.

Eighth Example Embodiment

Figure 14A:
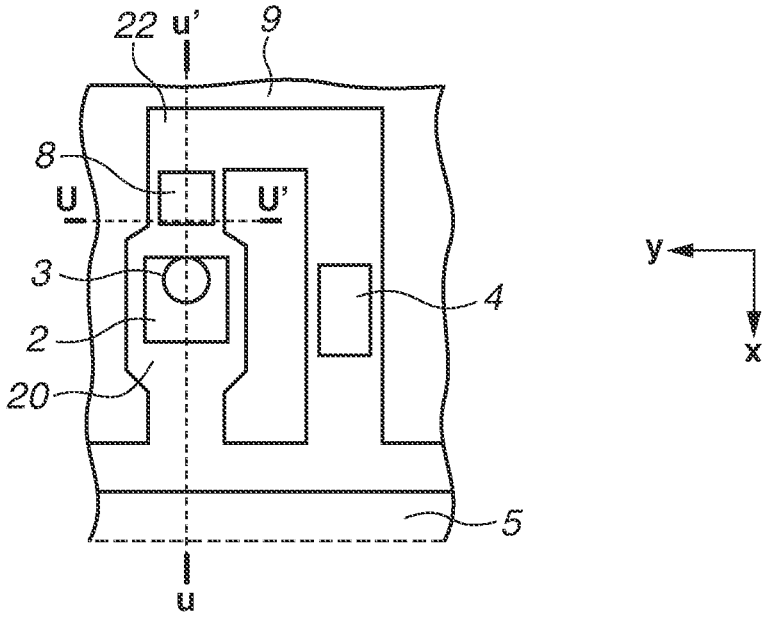
FIGS. 14A to 14C are schematic views each illustrating a recording element substrate according to an eighth example embodiment.
Figure 14B:
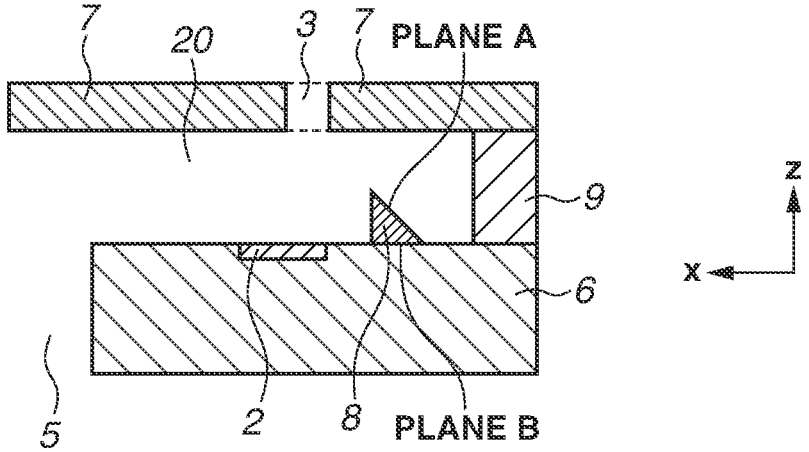
Figure 14C:
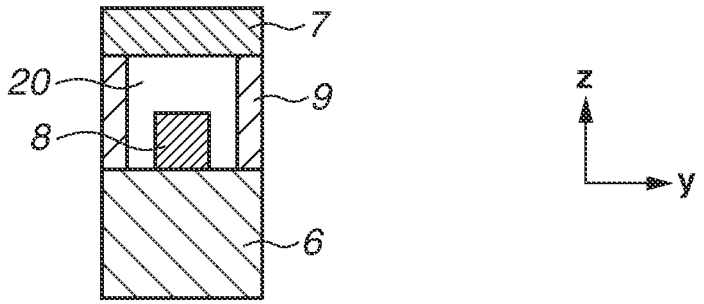

An eighth example embodiment will be described with reference to FIGS. 14A to 14C. The components similar to those of the first example embodiment are denoted by the same reference numerals or signs, and the description thereof is thus omitted. FIG. 14A is a schematic view illustrating a recording element substrate according to the eighth example embodiment. FIG. 14B is a schematic view illustrating a cross section along a line u-u' illustrated in FIG. 14A. FIG. 14C is a schematic view illustrating a cross section along a line U-U' illustrated in FIG. 14A.

The present example embodiment is characterized in that the center of the discharge port 3 does not align with the center of the energy generating element 2. With this configuration, the structure 8 can be arranged at a position away from the energy generating element 2 without changing the distance between the discharge port 3 and the structure 8 in a case where it is difficult to arrange the structure 8 close to the energy generating element 2. In the configuration, since the distance between the discharge port 3 and the structure 8 is not changed, liquid can flow to the inside of the discharge port 3 in a similar manner to the example embodiments described above. FIGS. 14A to 14C illustrate an example in which the structure 8, which has a height of 10 μm and the plane B having a length of 10 μm, is formed at a position 5 μm away from the energy generating element 2.

Figure 7A:
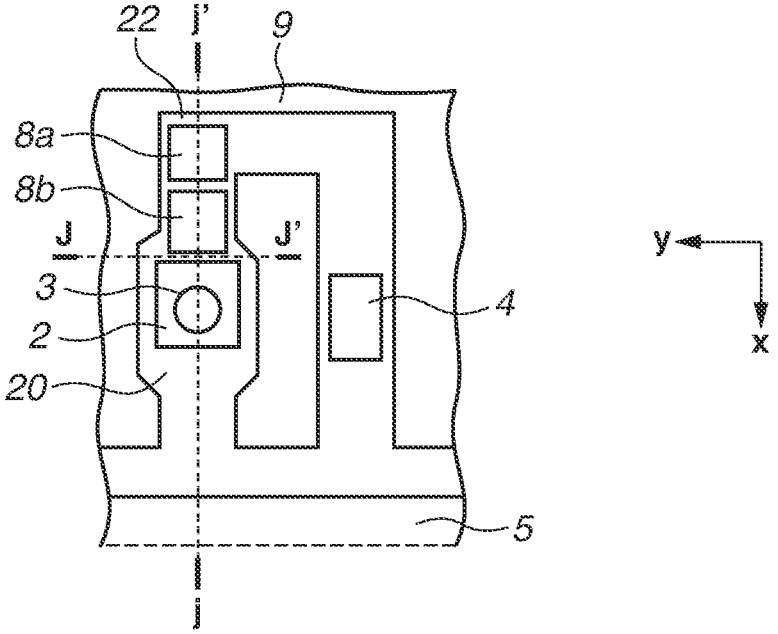
FIGS. 7A to 7C are schematic views each illustrating a recording element substrate according to another example embodiment.
Figure 7B:
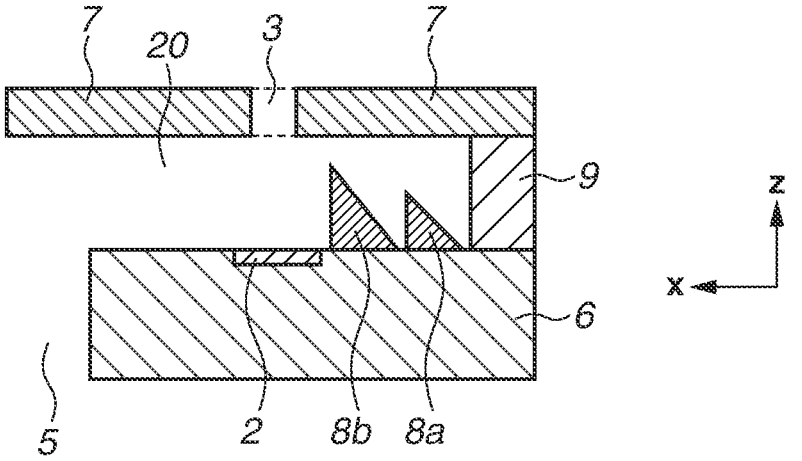
Figure 7C:
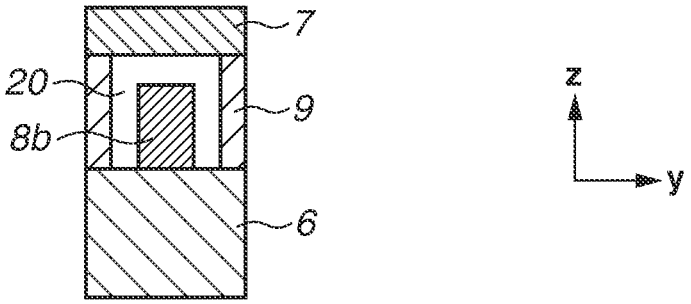

While the above description has been given of the example in which only one structure 8 is arranged in the pressure chamber 20 or the liquid flow path 22, the number of structures 8 is not limited thereto. A plurality of structures 8 may be arranged in the pressure chamber 20 or the liquid flow path 22 as illustrated in FIGS. 7A to 7C, which also produces the same effect. If the number of the structures 8 increases, however, the structures 8 to fill a larger part of the liquid flow path 22 is blocked, thereby creating an issue in the refill speed of liquid. From the foregoing reason, it is desirable that one structure 8 be arranged in the pressure chamber 20 or the liquid flow path 22.

Example Modification of Recording Element Substrate

Figure 15A:
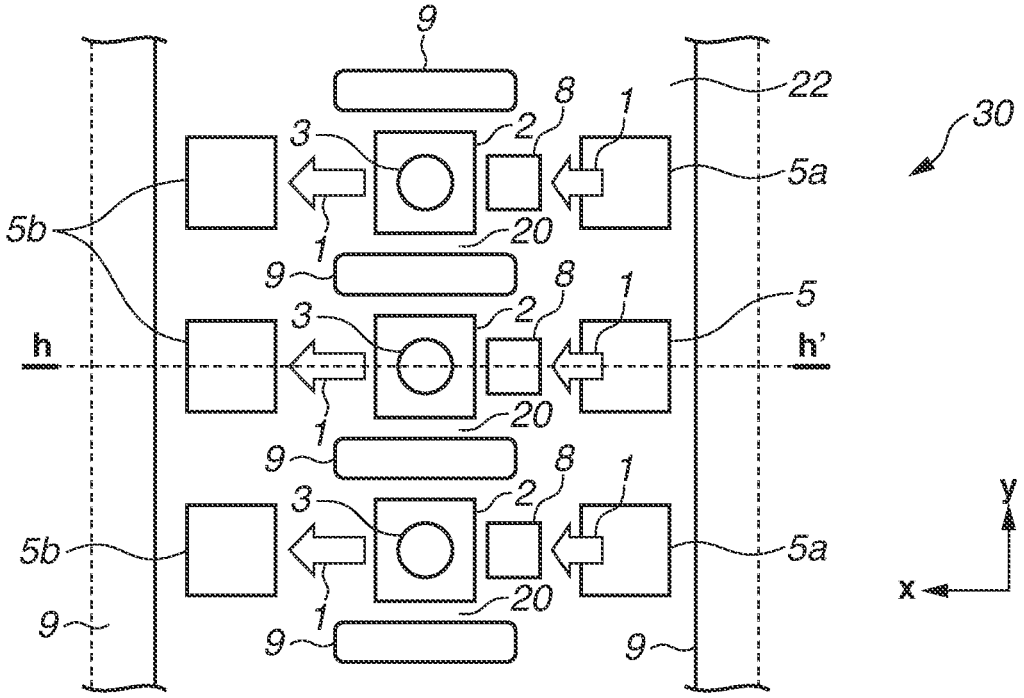
FIGS. 15A and 15B illustrate a modification of a recording element substrate.
Figure 15B:
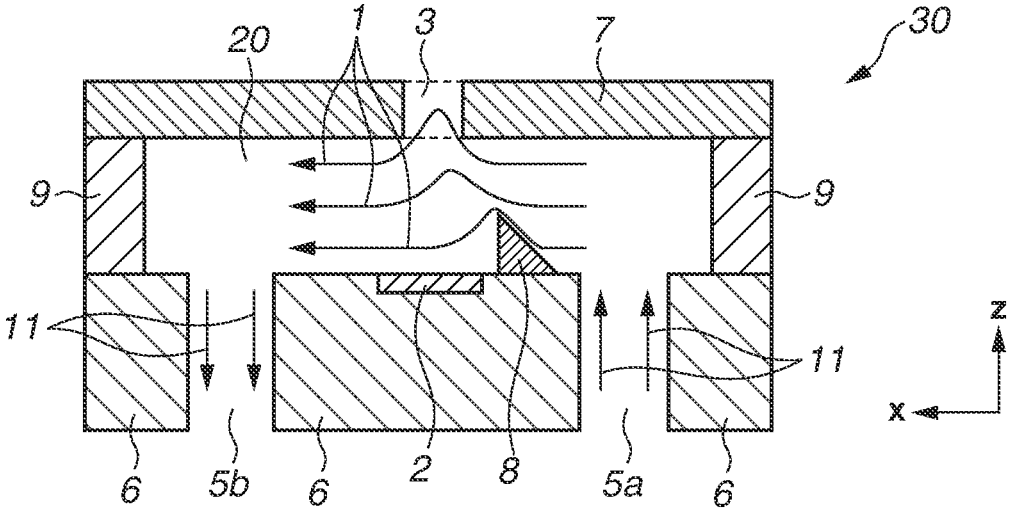

FIGS. 15A and 15B illustrate a modification of a recording element substrate according to the present disclosure. In a recording element substrate 30 illustrated in FIGS. 15 A and 15B, differential pressure generated outside the recording element substrate 30 circulates liquid. Liquid flows into the pressure chamber 20 from a liquid supply port 5*a* formed in the substrate 6, while liquid that has not been discharged from the discharge port 3 flows to a liquid outlet port 5*b*. In a case where the recording element substrate 30 illustrated in FIGS. 15A and 15B has no structure 8, the flow of liquid to the inside of the discharge port 3 may not be generated sufficiently. However, arranging the structure 8 causes liquid to flow to the inside of the discharge port 3, which can prevent the increase in viscosity of liquid inside the discharge port 3, similarly to the case illustrated in FIGS. 3A to 3C.

Example Manufacturing Method

A manufacturing method of the liquid discharge head having the structure 8 described above will be described next with reference to FIGS. 16A to 16E and FIG. 17. Processes other than processes to form the structure are the same as the typical processes to manufacture liquid discharge heads, and thus description will be given to only processes for the recording element substrate having the structure. FIGS. 16A to 16E are schematic views illustrating manufacturing processing for forming the structure 8 on the recording element substrate. FIG. 17 is a flow chart for the manufacturing processing illustrated in FIGS. 16A to 16E.

Figure 16A:
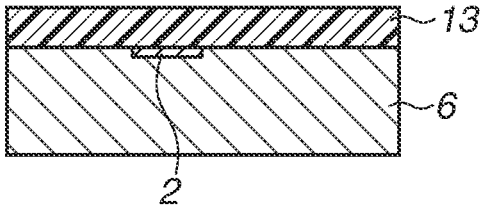
FIGS. 16A to 16E are schematic views illustrating example manufacturing processing.
Figure 17:
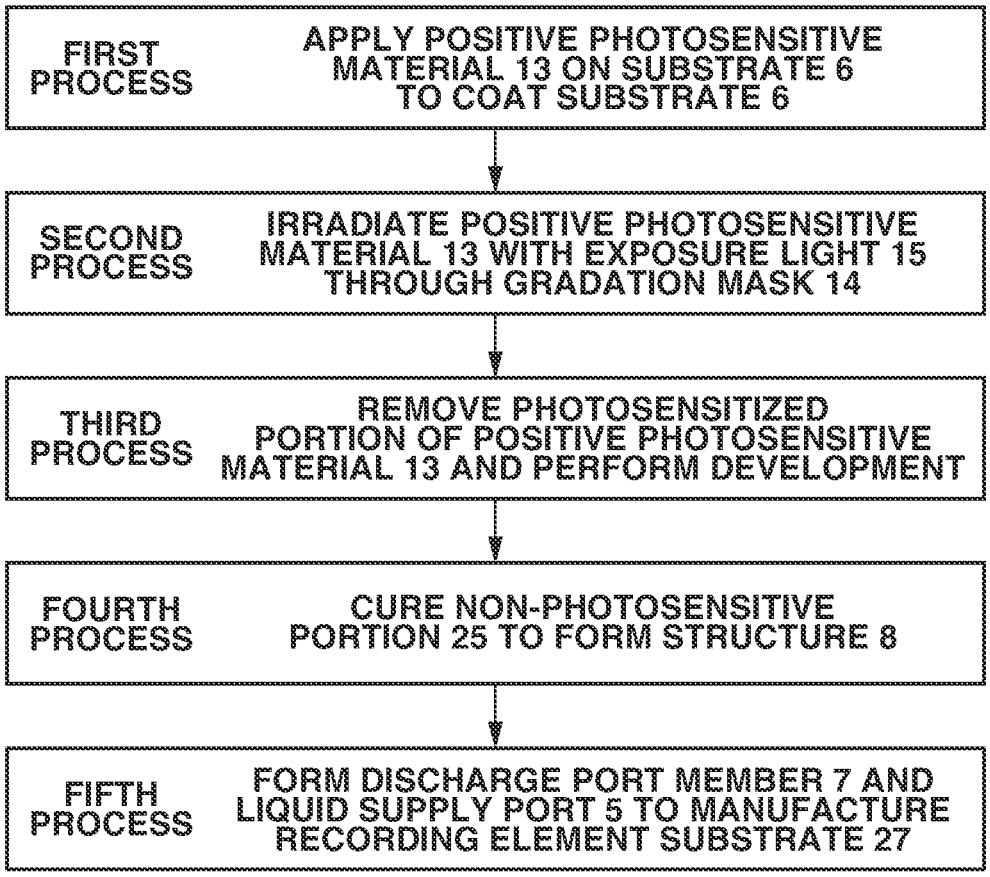
FIG. 17 is a flow chart illustrating the manufacturing processing.

First, as illustrated in FIG. 16A, a positive photosensitive material 13 is applied on the substrate 6 made of silicon or the like, in which the energy generating element 2 is formed, to coat the substrate 6 (in first process in FIG. 17).

Figure 16B:
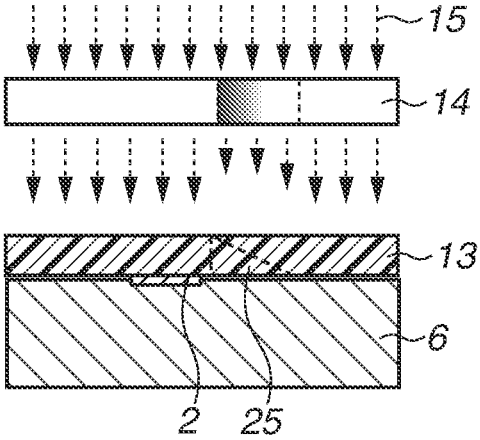

As illustrated in FIG. 16B, the positive photosensitive material 13 is irradiated with exposure light 15 through a gradation mask 14 to form a photosensitive portion and a non-photosensitive portion 25 (in second process in FIG. 17). The gradation mask 14 is a mask in which transmittance of the exposure light 15 gradually changes. Thus, when the positive photosensitive material 13 (resin) is irradiated with the exposure light 15 through the gradation mask 14, an exposure intensity is high in part of the positive photosensitive material 13 which corresponds to part of the gradation mask 14 having high transmittance of the exposure light 15, while an exposure intensity is low in part of the positive photosensitive material 13 which corresponds to part of the gradation mask 14 having low transmittance of the exposure light 15. In this manner, an exposure intensity gradually changes depending on the position, which facilitates the exposure process to form an object having an inclination such as the structure 8.

Since the present example embodiment employs the positive photosensitive material 13, excessive exposure of the positive photosensitive material 13 to the exposure light 15 may even photosensitize a shielded portion that is to be shielded from the exposure light 15. Thus, it is desirable to select a minimum exposure amount necessary for photosensitizing the positive photosensitive material 13 to facilitate the gradation of different levels of exposure. It is important to select as appropriate an optimal combination of a gradient of the gradation of the gradation mask 14 and an exposure amount depending on the case where, for example, the structure 8 is desired to have a steep inclination or a gentle inclination. The exposure process allows formation of the structure 8 having a desired shape.

Figure 16C:
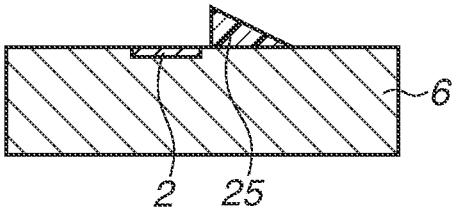
Figure 16D:
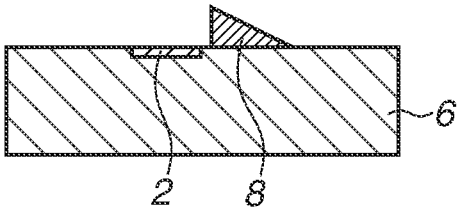
Figure 16E:
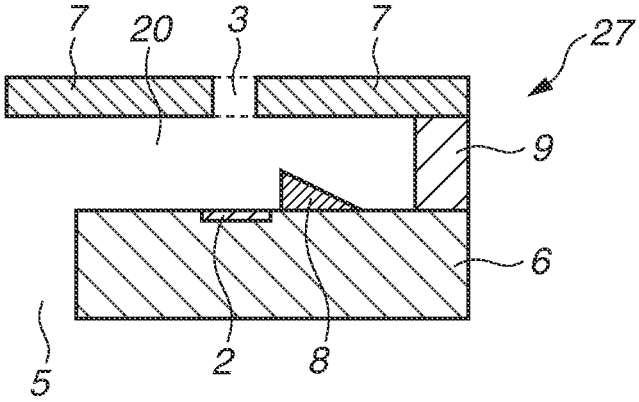

Subsequently, as illustrated in FIG. 16C, the photosensitized portion of the positive photosensitive material 13 is removed and development is performed (in third process in FIG. 17). Subsequently, as illustrated in FIG. 16D, energy such as heat is applied to the non-photosensitive portion 25 to cure the non-photosensitive portion 25, whereby forming the structure 8 (in fourth process in FIG. 17). Finally, as illustrated in FIG. 16E, the discharge port member 7 having the flow path member 9 and the discharge port 3 is formed on the substrate 6, and the liquid supply port 5 is formed in the substrate 6 by etching, so that the recording element substrate 27 including the substrate 6 having a desired shape can be manufactured (in fifth process in FIG. 17).

Example Embodiment of Manufacturing Method

The manufacturing method illustrated in FIGS. 16A to 16E will be described in detail. First, the substrate 6 made of silicon in which the energy generating element 2 has been formed in advance is prepared. Subsequently, the typical positive photosensitive material 13, such as PMER, is applied on the surface of the substrate 6 made of silicon using a typical spin coater or laminator to coat the substrate 6. At this time, a coating layer thickness is 10 μm. Subsequently, the gradation mask 14 provided with a mask pattern by which transmittance of the exposure light 15 gradually changes so as to obtain a desired shape is prepared, and the positive photosensitive material 13 is exposed to light in an exposure amount of 10000 J/m$^2$. Subsequently, development is performed and the photosensitized portion of the positive photosensitive material 13 is removed. Subsequently, heat treatment is performed at 120° C. for five minutes to cure the resultant pattern. By performing the foregoing processes, the structure 8 having the height $D_1$ of 10 μm is formed on the substrate 6. Subsequently, a member for forming the flow path member 9 having a height of 20 μm is formed on the substrate 6 on which the structure 8 is formed, and then patterning is performed. Finally, a member for forming the discharge port member 7 having a height of 10 μm is formed on the substrate 6, and patterning is performed to form the discharge port 3.

Another Example Manufacturing Method

Another manufacturing method of the liquid discharge head will be described with reference to FIGS. 18A to 18E, FIG. 19, FIGS. 20A to 20G, and FIG. 21. As described above, processes other than processes to form the structure are the same as the typical processes to manufacture liquid discharge heads, and thus description will be given to only the processes for the recording element substrate having the structure. FIGS. 18A to 18E and FIG. 19 each illustrate a method for forming the structure 8 by embossing using an imprint material 16 and a mold 17.

Figure 18A:
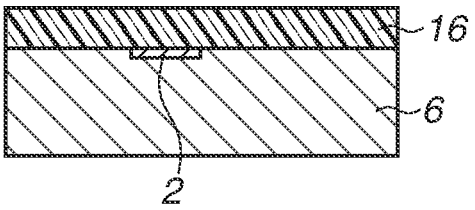
FIGS. 18A to 18E are schematic views illustrating another example manufacturing processing.
Figure 18B:
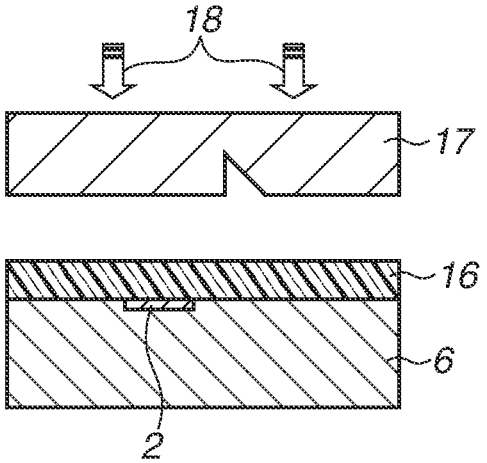
Figure 18C:
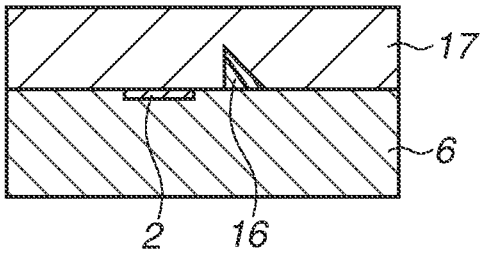
Figure 18D:
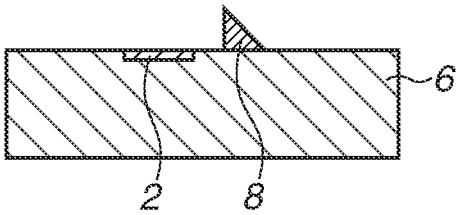
Figure 18E:
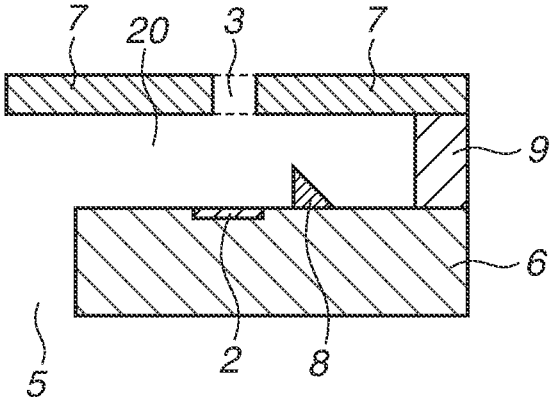
Figure 19:
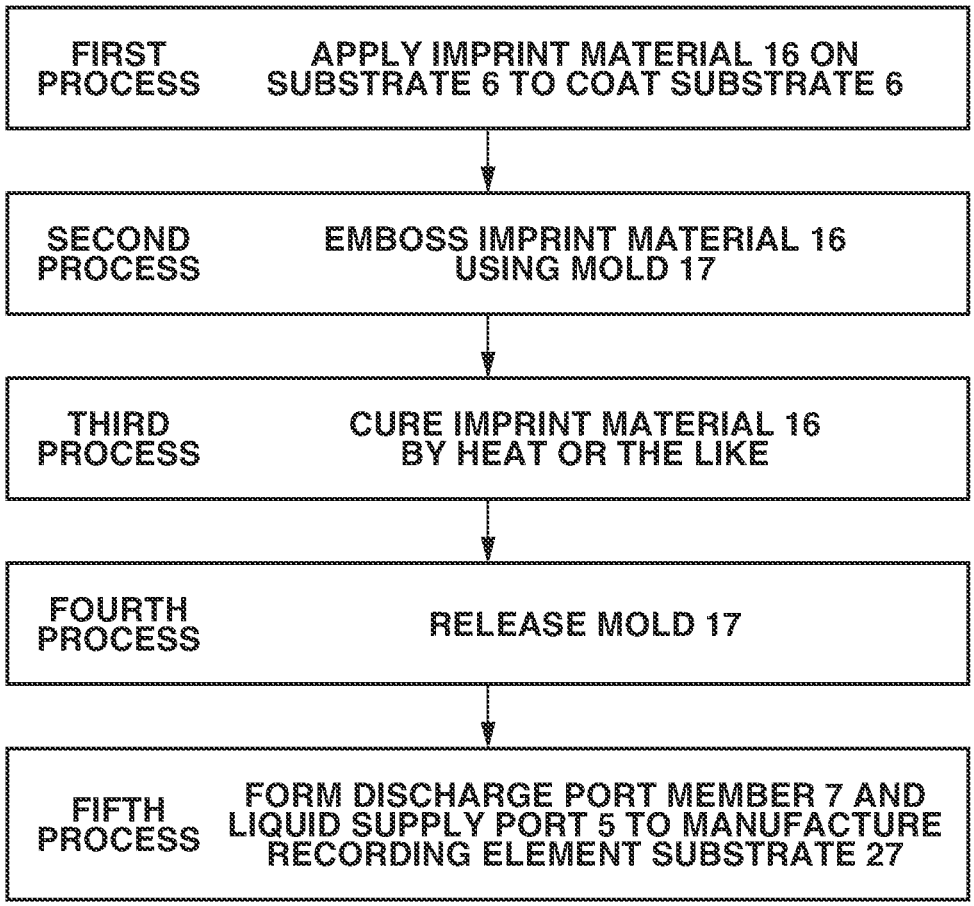
FIG. 19 is a flow chart for the another manufacturing processing.

First, as illustrated in FIG. 18A, the imprint material 16 is applied on the substrate 6 to coat the substrate 6 (in first process in FIG. 19). Subsequently, as illustrated in FIG. 18B, pressure 18 for embossing is applied to the imprint material 16 using the mold 17 (in second process in FIG. 19). The desired shape has been formed in the mold 17 in advance, a shape having a steep inclination, a shape having a gentle inclination, and other complicated shapes can be formed relatively easily. Subsequently, as illustrated in FIG. 18C, the imprint material 16 is cured by heat or the like in a state where the imprint material 16 is being embossed using the mold 17 (in third process in FIG. 19). Subsequently, as illustrated in FIG. 18D, the mold 17 is released (in fourth process in FIG. 19). Finally, as illustrated in FIG. 18E, the flow path member 9 and the discharge port member 7 are formed on the substrate 6, and the liquid supply port 5 is also formed in the substrate 6, so that the recording element substrate 27 including the structure 8 having a desired shape can be manufactured (in fifth process in FIG. 19).

The manufacturing method illustrated in FIGS. 18A to 18E will be described in detail. First, the substrate 6 made of silicon where the energy generating element 2 has been formed in advance is prepared. Subsequently, the imprint material 16, such as an ultraviolet curable resin and a thermosetting resin, which is typically used for imprint processing, is applied on the surface of the silicon substrate 6 to coat the substrate 6. An amount of coating is calculated as appropriate based on a volume of the structure 8. Here, the amount of coating is adjusted such that the height of the structure 8 is 15 μm. Subsequently, the mold 17 that is made of silica glass or the like and has been processed to have the shape of a triangle is prepared, and then the mold 17 is pressed against the imprint material 16 from above with the pressure 18 to form the shape of the structure 8 on the substrate 6. In that state, heat treatment is performed at 120° C. for five minutes to cure the imprint material 16 which has been formed as the structure 8, and then the mold 17 is released. Subsequently, the member for forming the flow path member 9 having a height of 20 μm is formed on the substrate 6, on which the structure 8 has been formed, and then the patterning is performed. Finally, the member for forming the discharge port member 7 having a height of 10 μm is formed thereon, and the patterning is performed to form the discharge port 3.

Another Example Manufacturing Method

Figure 20A:
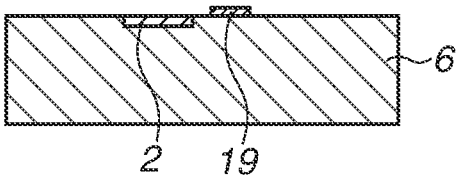
FIGS. 20A to 20G are schematic views illustrating yet another manufacturing processing.
Figure 20B:
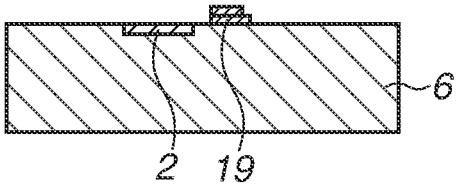
Figure 20C:
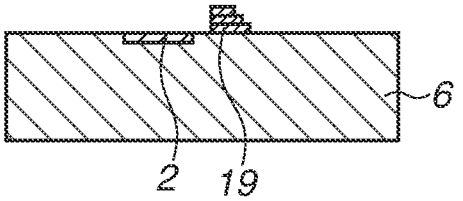
Figure 20D:
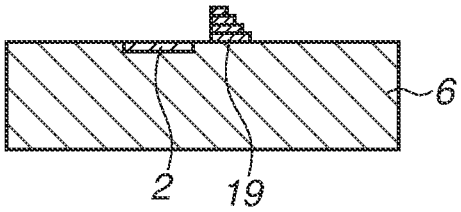
Figure 20E:
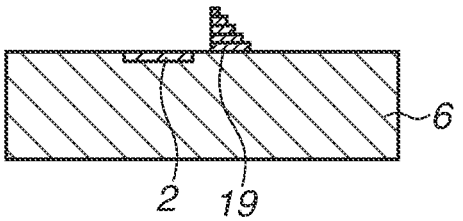
Figure 20F:
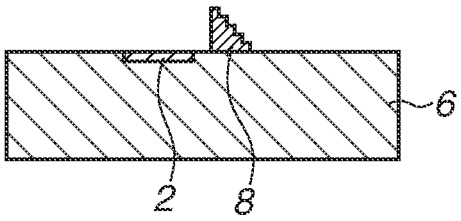
Figure 20G:
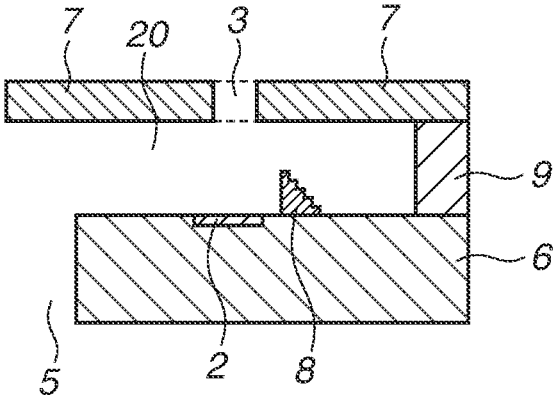
Figure 21:
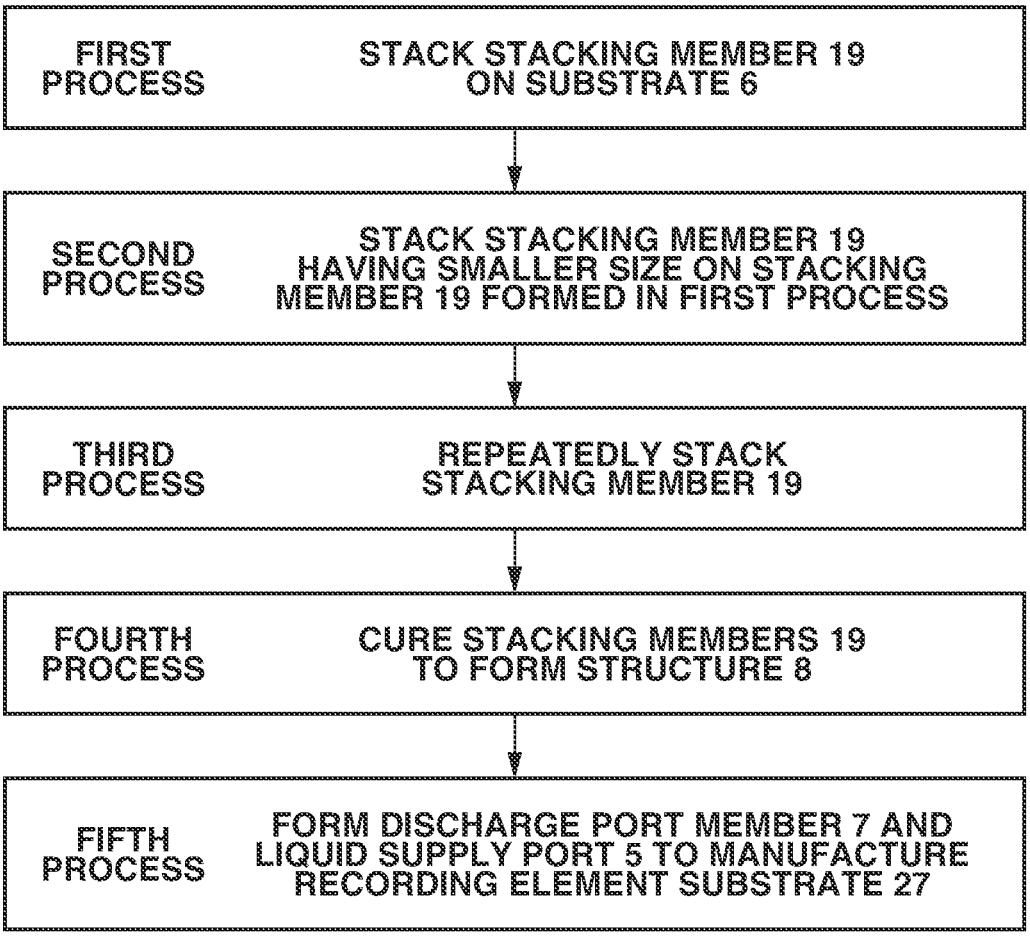
FIG. 21 is a flow chart illustrating the yet another manufacturing processing.

A method of forming the structure 8 by repeatedly stacking stacking members 19 will be described next with reference to FIGS. 20A to 20G and FIG. 21. Although patterning needs to be repeated multiple times in this method, a desired shape can be obtained with higher reproducibility in this method than the method using the gradation mask 14. Adjusting a film thickness and size per layer of the stacking member 19 as appropriate can produce the structure 8 having a desired shape. First, as illustrated in FIG. 20A, the stacking member 19 such as a photosensitive material is formed on the substrate 6 (in first process in FIG. 21). Subsequently, as illustrated in FIG. 20B, another stacking member 19 having a smaller size is formed on the stacking member 19 that has been formed in the first process in FIG. 20A (in second process in FIG. 21). As illustrated in FIGS. 20C to 20E, a stacking member 19 having a smaller size is repeatedly stacked thereon (in third process in FIG. 21). As illustrated in FIG. 20F, energy such as heat or the like is applied to the stacking members 19 that have been stacked in the processes illustrated in FIGS. 20A to 20E to cure the stacking members 19, thereby forming the structure 8 (in fourth process in FIG. 21). Finally, as illustrated in FIG. 20G, the flow path member 9 and the discharge port member 7 are formed on the substrate 6, and the liquid supply port 5 is also formed in the substrate 6, so that the recording element substrate 27 including the structure 8 having a desired shape can be manufactured (in fifth process in FIG. 19).

The method of forming the structure 8 by repeatedly stacking the stacking members 19 produces a plurality of corners. Thus, the corners may be rounded by baking at a high temperature. If the corners are eliminated, the flow of liquid can be prevented from stagnating near the corners.

The manufacturing method illustrated in FIGS. 20A to 20G will be described in detail. First, the silicon substrate 6 in which the energy generating element 2 has been formed in advance is prepared. Subsequently, a layer made of a typical negative photosensitive epoxy resin or the like, from which the stacking member 19 is formed, is applied on the surface of the substrate 6 made of silicon using a typical spin coater or laminator to coat the substrate 6. At this time, a coating layer thickness is 2 μm. Subsequently, the patterning is performed on the photosensitive epoxy resin by exposure and development to obtain a desired shape, and then the first layer of the stacking member 19 is obtained. At this time, a length in the x-direction of the first layer of the stacking member 19 is 10 μm. Subsequently, another layer made of the typical negative photosensitive epoxy resin or the like, from which the stacking member 19 is formed, is applied on the surface of the first layer using the typical spin coater or laminator. A coating layer thickness is also 2 μm. Subsequently, the patterning is performed on the photosensitive epoxy resin by exposure and development to obtain a desired shape, and then the second layer of the stacking member 19 is obtained. At this time, a length in the x-direction of the second layer of the stacking member 19 is 8 μm. The patterning is repeated five times to obtain the stacking member 19 formed in a step-like shape and having a height of 10 μm and a length of 10 μm. Subsequently, heat treatment is performed at 120° C. for five minutes to cure the stacking member 19. Subsequently, the material for forming the flow path member 9 having a height of 20 μm is applied on the substrate 6, on which the structure 8 is formed, and then the patterning is performed thereon. Finally, the material for forming the discharge port member 7 having a height of 10 μm is applied thereon, and the patterning is performed to form the discharge port 3.

According to the present disclosure, an increase in viscosity of liquid inside the discharge port can be prevented.

While the present disclosure has been described with reference to example embodiments, it is to be understood that the disclosure is not limited to the disclosed example embodiments. The scope of the following claims is to be accorded the broadest interpretation so as to encompass all such modifications and equivalent structures and functions.

This application claims the benefit of Japanese Patent Application No. 2019-078176, filed Apr. 16, 2019, which is hereby incorporated by reference herein in its entirety.

What is claimed is:

1. A liquid discharge head, comprising:

a discharge port member including a discharge port from which liquid is discharged;

a flow path member including a pressure chamber internally having an energy generating element configured to generate energy to discharge the liquid from the discharge port, and a liquid flow path in which the liquid flows toward the pressure chamber;

a substrate including a liquid supply port from which the liquid is supplied to the liquid flow path; and a structure that is arranged on the substrate on an upstream side of a center of the discharge port in the pressure chamber or the liquid flow path and that is configured to generate a flow of the liquid toward the discharge port, wherein the liquid in the pressure chamber circulates between inside and outside of the pressure chamber, wherein a position corresponding to a portion of the structure having a greatest height from a surface of the substrate is located on the upstream side of the center of the discharge port in a flow direction of the liquid, and wherein a thickness of the structure in a discharge direction of the liquid is 0.1 times or greater than a thickness of the liquid flow path in the discharge direction of the liquid.

2. The liquid discharge head according to claim 1, wherein the thickness of the structure in the discharge direction of the liquid is 0.3 times or greater than the thickness of the liquid flow path in the discharge direction of the liquid.

3. The liquid discharge head according to claim 1, wherein the thickness of the structure in the discharge direction of the liquid is 0.5 times or greater than the thickness of the liquid flow path in the discharge direction of the liquid.

4. The liquid discharge head according to claim 1, wherein the thickness of the structure in the discharge direction of the liquid is 0.8 times or less than the thickness of the liquid flow path in the discharge direction of the liquid.

5. The liquid discharge head according to claim 1, wherein a length of the structure in a direction orthogonal to the flow direction of the liquid and the discharge direction of the liquid is equal to or greater than a length of the discharge port in the orthogonal direction.

6. The liquid discharge head according to claim 1, wherein the structure is mounted on the substrate.

7. The liquid discharge head according to claim 1, wherein a shape of the structure is a triangular prism, and a side surface of the triangular prism faces the substrate.

8. The liquid discharge head according to claim 7, wherein an angle between a plane of the structure facing the upstream side in the liquid flow path and a plane of the structure facing the substrate is an acute angle.

9. The liquid discharge head according to claim 7, wherein an angle between a plane of the structure facing the upstream side in the liquid flow path and a plane of the structure facing the substrate is a right angle.

10. The liquid discharge head according to claim 7, wherein an angle between a plane of the structure facing the upstream side in the liquid flow path and a plane of the structure facing the substrate is an obtuse angle.

11. The liquid discharge head according to claim 7, wherein the triangular prism is a right triangular prism.

12. The liquid discharge head according to claim 7, wherein an angle between a plane of the structure facing a downstream side in the liquid flow path and a plane of the structure facing the substrate is an acute angle.

13. The liquid discharge head according to claim 1, wherein a plane of the structure facing the upstream side in the liquid flow path is a curved surface.

14. The liquid discharge head according to claim 1, wherein the discharge port is located on an extension line of a plane of the structure facing the upstream side in the liquid flow path.

15. The liquid discharge head according to claim 1, wherein the discharge port has an inclined surface, a diameter of which decreases toward the discharge direction of the liquid, and wherein an angle between a plane of the structure facing the upstream side and a plane facing the substrate is substantially equal to an angle between the inclined surface and the substrate.

16. The liquid discharge head according to claim 1, wherein a shape of the structure is a rectangular prism.

17. The liquid discharge head according to claim 1, wherein the portion of the structure having the greatest height is in contact with the discharge port member.

18. The liquid discharge head according to claim 1, wherein the center of the discharge port does not align with a center of the energy generating element.

19. The liquid discharge head according to claim 1, wherein the substrate further includes a liquid outlet port from which the liquid is drained, which has not been discharged from the pressure chamber is drained to the outside.

20. The liquid discharge head according to claim 1, wherein a heating element is internally arranged in the liquid flow path, and wherein, by driving the heating element, the liquid in the pressure chamber circulates between the inside and outside of the pressure chamber.

* * * * *